US010466621B2

(12) United States Patent
Jang et al.

(10) Patent No.: US 10,466,621 B2
(45) Date of Patent: Nov. 5, 2019

(54) DEVELOPING CARTRIDGE AND ELECTROPHOTOGRAPHIC IMAGE FORMING APPARATUS EMPLOYING SAME

(71) Applicant: HP Printing Korea Co., LTD., Suwon-si (KR)

(72) Inventors: Ho-jin Jang, Suwon (KR); Young-chae Kim, Suwon (KR); Yun-kyu Sim, Suwon (KR); Gun-soo Chang, Suwon (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 16/050,805

(22) Filed: Jul. 31, 2018

(65) Prior Publication Data

US 2018/0335720 A1 Nov. 22, 2018

Related U.S. Application Data

(63) Continuation of application No. PCT/KR2016/013854, filed on Nov. 29, 2016.

(30) Foreign Application Priority Data

May 10, 2016 (KR) ..... 10-2016-0057117

(51) Int. Cl.
*G03G 21/16* (2006.01)
*G03G 15/08* (2006.01)
*G03G 21/18* (2006.01)

(52) U.S. Cl.
CPC ..... *G03G 15/0865* (2013.01); *G03G 21/18* (2013.01); *G03G 15/0806* (2013.01)

(58) Field of Classification Search
CPC ..... G03G 21/1842; G03G 21/1647; G03G 21/1814; G03G 21/1821; G03G 5/0696
(Continued)

(56) References Cited

U.S. PATENT DOCUMENTS

2007/0177899 A1* 8/2007 Kawamura ..... G03G 15/0121 399/223
2009/0087218 A1 4/2009 Cheon et al.
2011/0044722 A1 2/2011 Agnissey et al.

FOREIGN PATENT DOCUMENTS

JP 2010107791 5/2010
KR 1020100132755 12/2010
KR 1020150127501 11/2015

OTHER PUBLICATIONS

Anzai, Shutter Device Working Also as Stop, Jan. 31, 1995, JP 07028127 A.*

* cited by examiner

*Primary Examiner* — Walter L Lindsay, Jr.
*Assistant Examiner* — Frederick Wenderoth
(74) *Attorney, Agent, or Firm* — Staas & Halsey LLP

(57) ABSTRACT

A developing cartridge includes: a photosensitive unit; a developing unit coupled to the photosensitive unit to be movable between a release position and a developing position; an elastic member to provide an elastic force in a direction to maintain the developing unit at the developing position; a movable member including a gear portion, the movable member and capable of moving to a first position to move the developing unit to the release position and second position to move the developing unit to the developing position; and a switching member connected to a driving gear, wherein as the driving gear rotates in a first direction or a second direction, the switching member is switched between a third position at which the switching member is connected to the gear portion to move the movable member from the second position to the first position and a fourth position at which the switching member is spaced apart from the gear portion to allow the
(Continued)

movable member to move from the first position to the second position.

15 Claims, 13 Drawing Sheets

(58) Field of Classification Search
USPC ..... 399/111
See application file for complete search history.

DEVELOPING CARTRIDGE AND ELECTROPHOTOGRAPHIC IMAGE FORMING APPARATUS EMPLOYING SAME

CROSS-REFERENCE TO RELATED APPLICATION(S)

This application is a continuation application of PCT international patent application no. PCT/KR2016/013854, filed on Nov. 29, 2016, which claims priority from Korean patent application no. 10-2016-0057117, filed on May 10, 2016, in the Korean Patent Office, the content of each of the foregoing is incorporated herein by reference.

BACKGROUND

Electrophotographic image forming apparatuses are used to print images on recording media by supplying toner to an electrostatic latent image formed on a photoconductor to form a visible toner image on the photoconductor, transferring the toner image onto a recording medium, and fusing the transferred toner image on the recording medium.

Developing cartridges are assemblies of components for forming visible toner images. Such a developing cartridge is a consumable item that is attached to a main body of an image forming apparatus and replaced with a new one when reaching the end of its lifetime. In a developing cartridge used in a contact developing method, a developing roller and a photoconductor are in contact with each other to form a developing nip.

BRIEF DESCRIPTION OF DRAWINGS

FIG. 2 illustrates a state in which a developing nip is formed as a photosensitive drum and a developing roller are brought into contact with each other, and FIG. 3 illustrates a state in which the developing nip is released as the photosensitive drum and the developing roller are spaced apart from each other.

DETAILED DESCRIPTION

Figure 1:
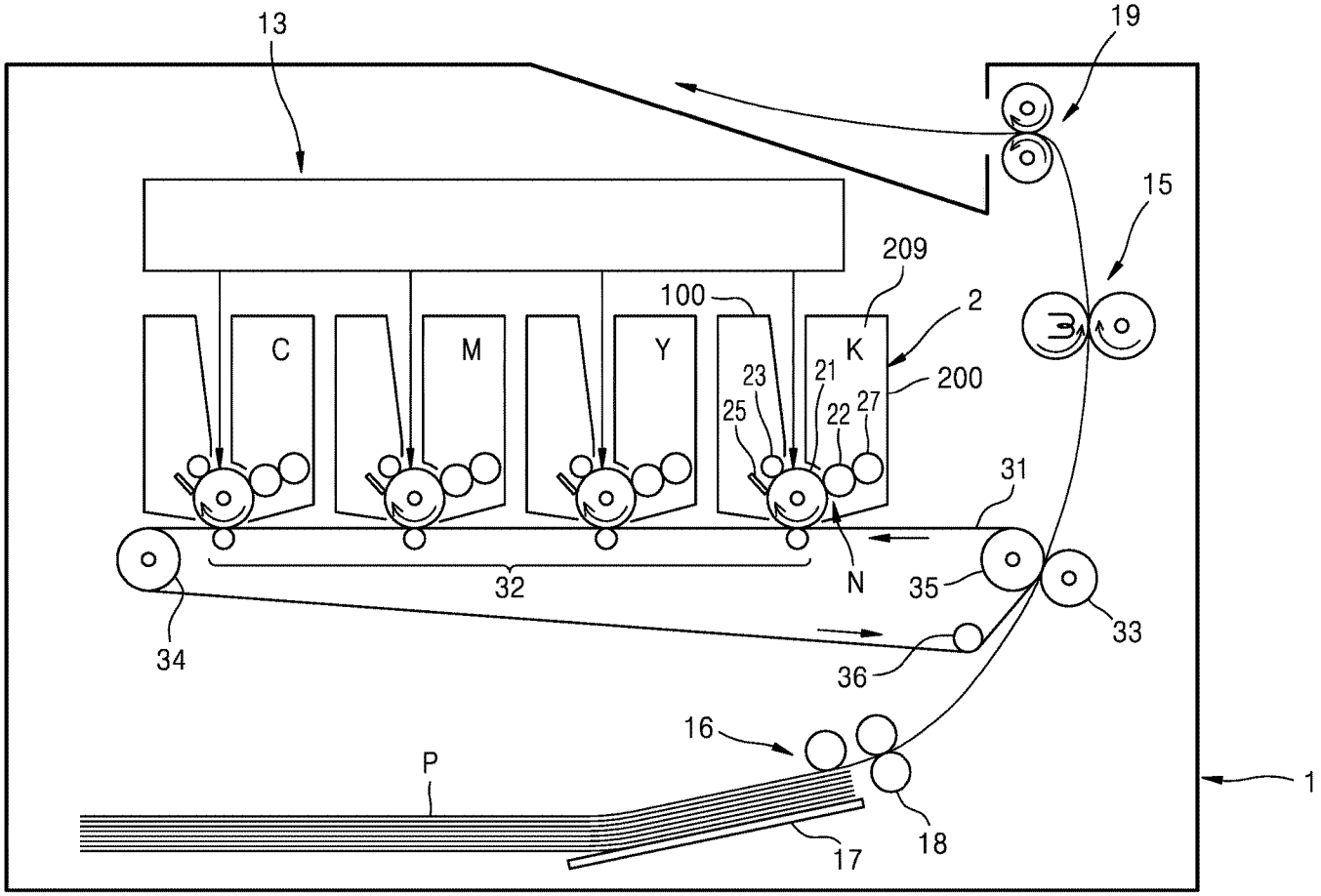
FIG. 1 is a schematic view illustrating an electrophotographic image forming apparatus according to an example.

Provided are a developing cartridge capable of forming/releasing a developing nip and an electrophotographic image forming apparatus including the developing cartridge.

If the developing nip is maintained for a long time, the developing roller may become deformed, and the photoconductor may be damaged. In this case, the deformed developing roller and the damaged photoconductor may cause variations in the developing nip, and thus the quality of images may be negatively affected.

According to examples of a developing cartridge and an electrophotographic image forming apparatus, a structure for forming/releasing a developing nip may be implemented inside the developing cartridge.

Hereinafter, an electrophotographic image forming apparatus and developing cartridges will be described in detail according to examples with reference to the accompanying drawings. In the following description and accompanying drawings, elements having substantially the same functions and structures are indicated with the same reference numerals, and repeated descriptions thereof will be omitted.

FIG. 1 is a schematic view illustrating an electrophotographic image forming apparatus according to an example. The image forming apparatus of the example is configured to print color images on a recording medium P by an electrophotographic method. Referring to FIG. 1, the image forming apparatus may include a main body 1, and a plurality of developing cartridges 2. The plurality of developing cartridges 2 are configured to be detachably attached to the main body 1. An exposure device 13, a transfer unit, and a fuser 15 are provided in the main body 1. In addition, a recording medium feed unit is provided in the main body 1 to receive and transport a recording medium P on which images are to be formed.

For color printing, the plurality of developing cartridges 2 may, for example, include four developing cartridges configured to develop cyan (C), magenta (M), yellow (Y), and black (K) images. Cyan (C), magenta (M), yellow (Y), and black (K) toners may be contained in the four developing cartridges 2, respectively. Although not illustrated in the drawing, cyan (C), magenta (M), yellow (Y), and black (K) toners may be contained in four toner supply containers and may be supplied to the four developing cartridges 2, respectively. The image forming apparatus may include other developing cartridges 2 containing toners having various colors such as light magenta or white. The case in which the image forming apparatus includes the four developing cartridges 2 will now be described. In the following description, unless otherwise specified, reference numerals used together with C, M, Y, and K indicate elements for developing cyan (C), magenta (M), yellow (Y), and black (K) images.

In the current example, the developing cartridges 2 are of an integrated type. Each of the developing cartridges 2 may include a photosensitive unit 100 and a developing unit 200.

The photosensitive unit 100 includes a photosensitive drum 21. The photosensitive drum 21 is an example of a photoconductor configured to form an electrostatic latent image thereon. The photosensitive drum 21 may include a conductive metal pipe and a photosensitive layer formed on an outer surface of the conductive metal pipe. A charging roller 23 is an example of a charger configured to charge the photosensitive drum 21 so that the photosensitive drum 21 may have a uniform surface potential. A charging brush or a corona charger may be used instead of the charging roller 23. The photosensitive unit 100 may further include a cleaning roller (not shown) to remove foreign substances from the surface of the charging roller 23. A cleaning blade 25 is an example of a cleaning device configured to remove toner or foreign substances remaining on the surface of the photosensitive drum 21 after a transfer process (described later). Another cleaning device such as a rotary brush may be used instead of the cleaning blade 25.

The developing unit 200 includes a toner container 209. The developing unit 200 supplies toner contained in the toner container 209 to an electrostatic latent image formed on the photosensitive drum 21 in order to develop the electrostatic latent image into a visible toner image. Examples of developing methods include a monocomponent developing method using toner, and a dual-component developing method using toner and a carrier. In the current example, the developing cartridge 2 uses the monocomponent developing method. A developing roller 22 is used to supply toner to the photosensitive drum 21. A developing bias voltage may be applied to the developing roller 22 in order to supply toner to the photosensitive drum 21.

In the current example, the developing roller 22 and the photosensitive drum 21 are in contact with each other to form a developing nip according to a contact developing method. A supply roller 27 supplies toner contained in the toner container 209 to the surface of the developing roller 22. To this end, a supply bias voltage may be applied to the supply roller 27. The developing unit 200 may further include a regulating member (not shown) to regulate the amount of toner to be supplied from the developing roller 22 to the developing nip N at which the photosensitive drum 21 and the developing roller 22 are in contact with each other. For example, the regulating member may be a doctor blade configured to make elastic contact with the surface of the developing roller 22.

The exposure device 13 emits light modulated according to image data toward the photosensitive drum 21 to form an electrostatic latent image on the photosensitive drum 21. Examples of the exposure device 13 may include a laser scanning unit (LSU) using a laser diode as a light source, and a light emitting diode (LED) exposure device using an LED as a light source.

The transfer unit may include an intermediate transfer belt 31, primary transfer rollers 32, and a secondary transfer roller 33. Toner images developed on the photosensitive drums 21 of the developing cartridges 2C, 2M, 2Y, and 2K are temporarily transferred to the intermediate transfer belt 31. The intermediate transfer belt 31 is rotated while being supported by support rollers 34, 35, and 36. The number of the primary transfer rollers 32 is four, and the primary transfer rollers 32 are arranged at positions respectively facing the photosensitive drums 21 of the developing cartridges 2C, 2M, 2Y, and 2K with the intermediate transfer belt 31 being placed therebetween. A primary transfer bias voltage is applied to the four primary transfer rollers 32 in order to primarily transfer toner images developed on the photosensitive drums 21 to the intermediate transfer belt 31. A corona transfer device or a pin scorotron type transfer device may be used instead of the primary transfer rollers 32. The secondary transfer roller 33 is located at a position facing the intermediate transfer belt 31. A secondary transfer bias voltage is applied to the secondary transfer roller 33 so that the toner images primarily transferred to the intermediate transfer belt 31 may be transferred to a recording medium P.

For example, if a printing command is received from a host (not shown), a controller (not shown) controls the charging rollers 23 to charge the photosensitive drums 21 with a uniformly potential. The exposure device 13 emits four light beams modulated according to color image data toward the photosensitive drums 21 of the developing cartridges 2C, 2M, 2Y, and 2K, in order to form electrostatic latent images on the photosensitive drums 21. The developing rollers 22 of the developing cartridges 2C, 2M, 2Y, and 2K respectively supply cyan (C), magenta (M), yellow (Y), and black (K) toners to the photosensitive drums 21 in order to develop electrostatic latent images into visible toner images. The developed toner images are primarily transferred to the intermediate transfer belt 31. A recording medium P placed on a loading table 17 is picked up sheet by sheet by a pickup roller 16 and is fed by feed rollers 18 to a transfer nip formed between the secondary transfer roller 33 and the intermediate transfer belt 31. The toner images primarily transferred to the intermediate transfer belt 31 are secondarily transferred to the recording medium P by the secondary transfer bias voltage applied to the secondary transfer roller 33. While the recording medium P passes through the fuser 15, the toner images are fused on the recording medium P by heat and pressure. After the toner images are fused on the recording medium P, the recording medium P is discharged by discharge rollers 19.

The developing cartridges 2C, 2M, 2Y, and 2K may be attached to and detached from the main body 1 through a door (not shown).

Figure 2:
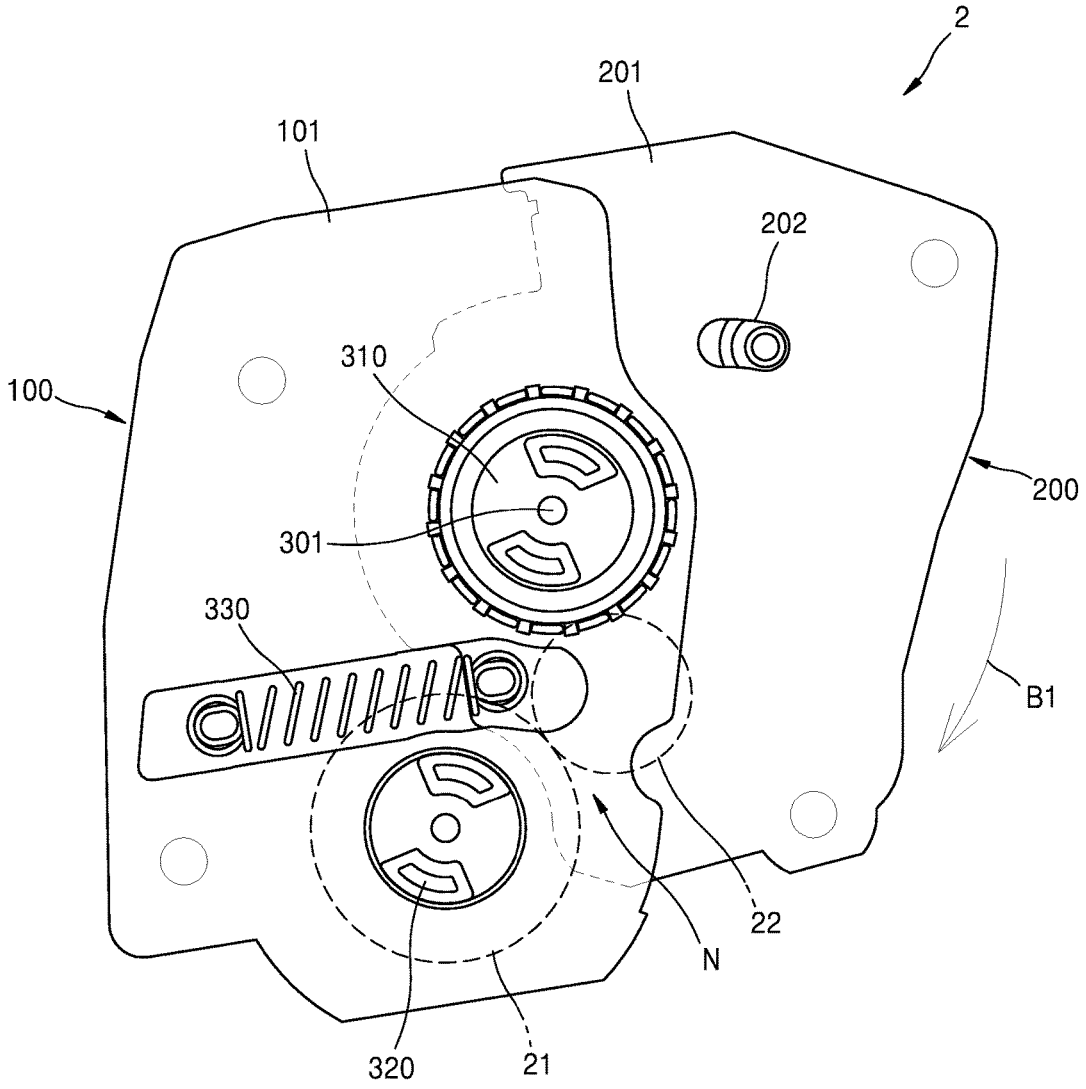
FIGS. 2 and 3 are side views illustrating a developing cartridge according to an example.
Figure 3:
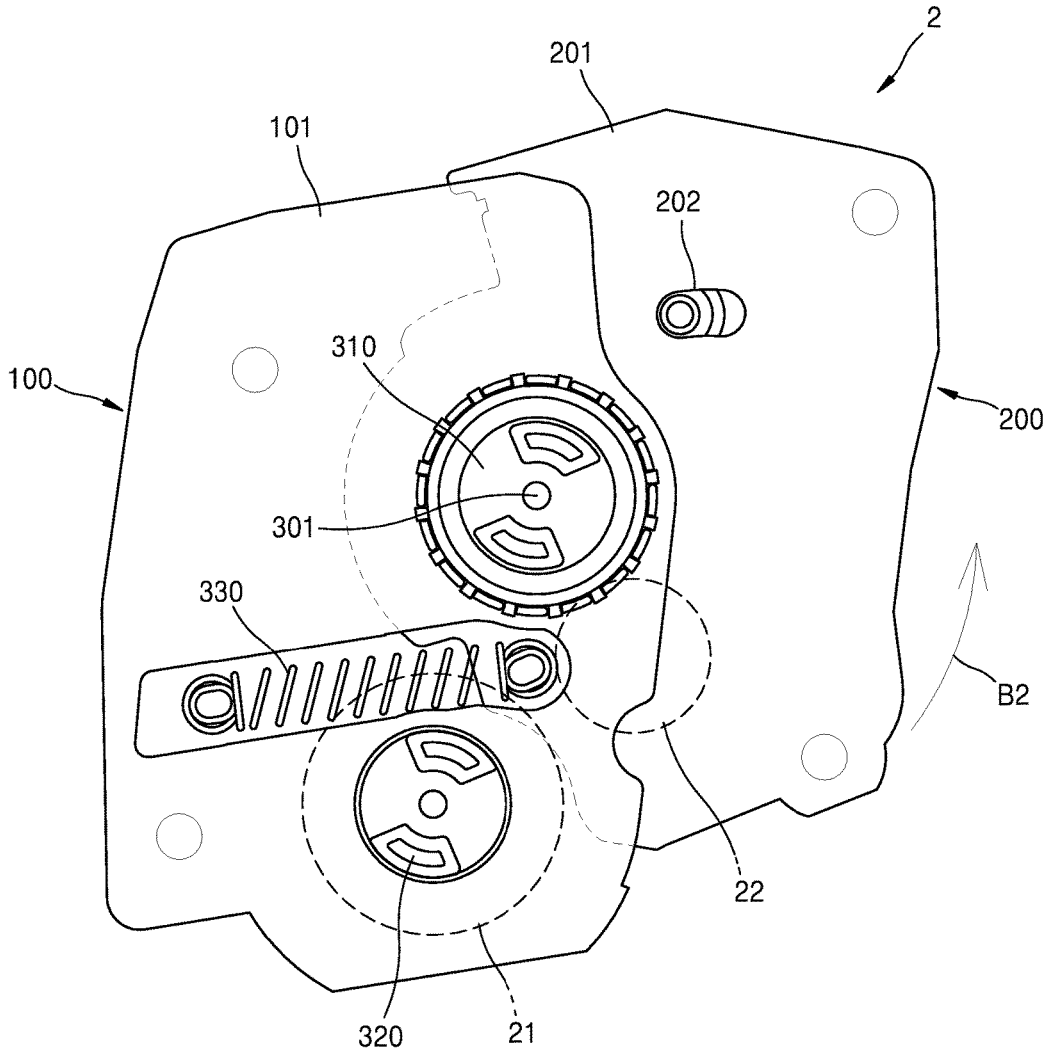

FIGS. 2 and 3 are side views illustrating a developing cartridge 2 according to an example. FIG. 2 illustrates a state in which a photosensitive drum 21 and a developing roller 22 are in contract with each other to form a developing nip N, and FIG. 3 illustrates a state in which the photosensitive drum 21 and the developing roller 22 are spaced apart from each other to release the developing nip N.

Referring to FIGS. 2 and 3, the developing cartridge 2 includes a photosensitive unit 100 and a developing unit 200. The photosensitive unit 100 includes a first frame 101 and the photosensitive drum 21 supported on the first frame 101. The developing unit 200 includes a second frame 201 and the developing roller 22 supported on the second frame 201. The photosensitive unit 100 and the developing unit 200 are connected in such a manner that the photosensitive unit 100 and the developing unit 200 are rotated to a developing position (FIG. 2) at which the photosensitive drum 21 and the developing roller 22 make contact with each other and form the developing nip N, and to a release position (FIG. 3) at which the photosensitive drum 21 and the developing roller 22 are spaced apart from each other to release the developing nip N. For example, the photosensitive unit 100 and the developing unit 200 are connected to each other in such a manner that the photosensitive unit 100 and the developing unit 200 are rotatable on a hinge shaft 301 between the developing position and the release position. In an image forming apparatus, the photosensitive drum 21 is related to the position of a device such as a primary transfer roller 32, and thus once the developing cartridge 2 is installed in a main body, the position of the photosensitive drum 21 may be fixed. The developing unit 200 may be coupled to the photosensitive unit 100 in such a manner that the developing unit 200 may be rotatable on the hinge shaft 301.

When the developing cartridge 2 is installed in the main body 1, rotary members of the developing cartridge 2 such as the photosensitive drum 21, the developing roller 22, and a supply roller 27 may be connected to a driving motor (not shown) provided in the main body 1 and may be driven by the driving motor. For example, the developing cartridge 2 may include a coupler 310 configured to be connected to the driving motor (not shown) of the main body 1 when the developing cartridge 2 is installed in the main body 1. The rotary members may be connected to the coupler 310 through power connection devices (not shown) such as gears. The developing cartridge 2 may further include a coupler 320 configured to be connected to the driving motor (not shown) of the main body 1 when the developing cartridge 2 is installed in the main body 1. In this case, rotary members of the developing unit 200 such as the developing roller 22 and the supply roller 27 may be connected to the coupler 310, and rotary members of the photosensitive unit 100 such as the photosensitive drum 21 may be connected to the coupler 320. For example, the coupler 320 may be coaxial with a rotation shaft of the photosensitive drum 21 and may be installed on the rotation shaft of the photosensitive drum 21. For example, the hinge shaft 301 may be coaxial with a rotation shaft of the coupler 310.

An elastic member 330 provides elastic force in a direction forming the developing nip N. The elastic member 330 applies elastic force to the developing unit 200 to rotate the developing unit 200 in a direction forming the developing nip N. Owing to the elastic force provided by the elastic member 330, the developing unit 200 may be rotated on the hinge shaft 301 to bring the developing roller 22 into contact with the photosensitive drum 21 and thus to form the developing nip N as shown in FIG. 2. In FIGS. 2 and 3, a tension coil spring having an end portion supported on the photosensitive unit 100 and the other end portion supported on the developing unit 200 is illustrated as an example of the elastic member 330. However, the elastic member 330 is not limited thereto. For example, the elastic member 330 may be selected from various members such as a torsion coil spring and a leaf spring.

During an image forming process, the photosensitive drum 21 and the developing roller 22 are in contact with each other and form the developing nip N. If the photosensitive drum 21 and the developing roller 22 are in contact with each other while images are not formed, the developing roller 22 may be deformed, and a photoconductor may be damaged. In addition, when a plurality of images are consecutively printed, if contact between the photosensitive drum 21 and the developing roller 22 are maintained during non-image-forming periods between image forming periods, the amount of toner consumption and the amount of waste toner may increase because toner is transferred from the developing roller 22 to the photosensitive drum 21, and the lifespan of the developing roller 22 may be shortened by stress because the photosensitive drum 21 is rotated in contact with the developing roller 22.

To address this, the developing cartridge 2 of the current example is configured such that the developing unit 200 may be switched between the developing position at the developing nip N is formed and the release position at which the developing nip N is released. In the developing cartridge 2 of the current example, the developing unit 200 is placed at the developing position during printing (during an image forming process and an image forming period), and at the release position when printing is not performed (when an image forming process is not performed and during a non-image-forming period).

Figure 4:
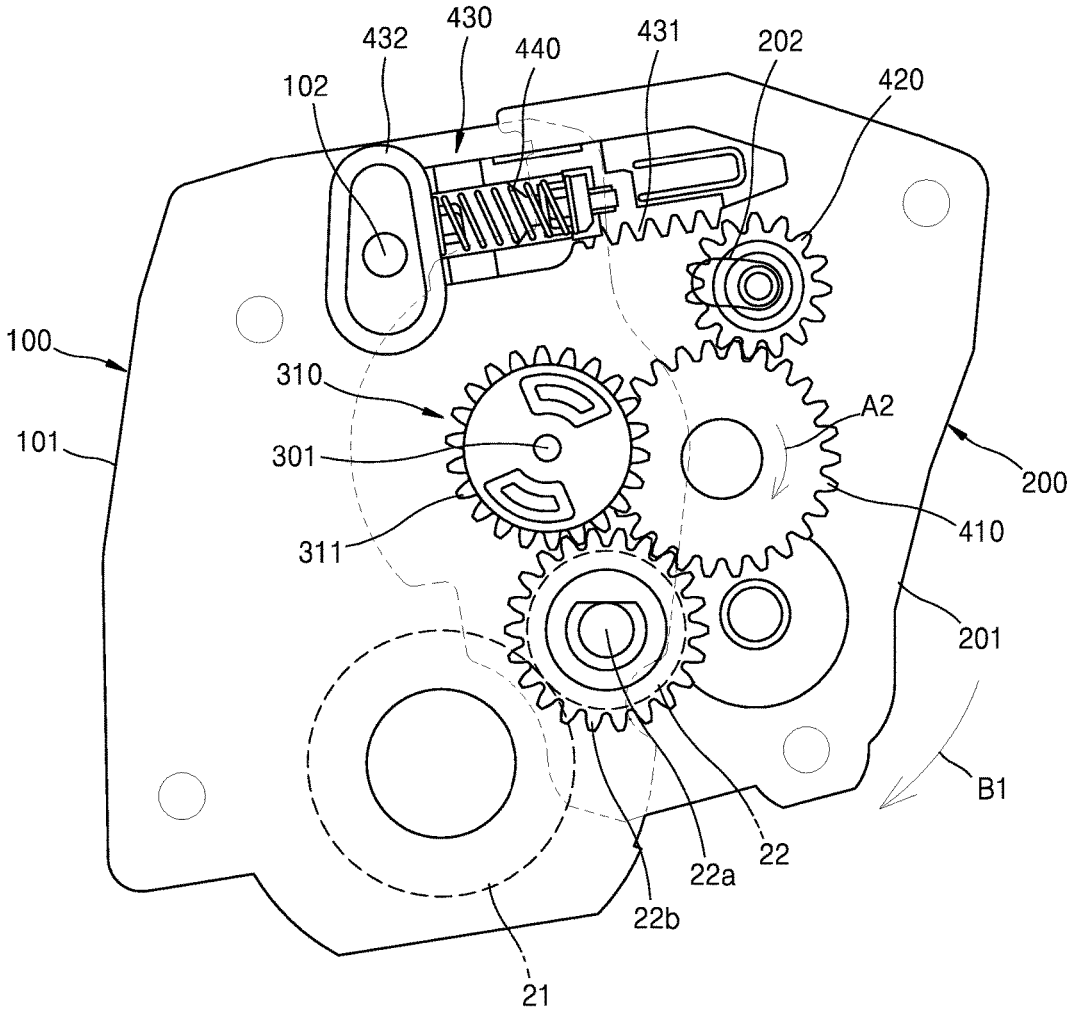
FIG. 4 is a schematic side view illustrating a developing cartridge according to an example.
Figure 5:
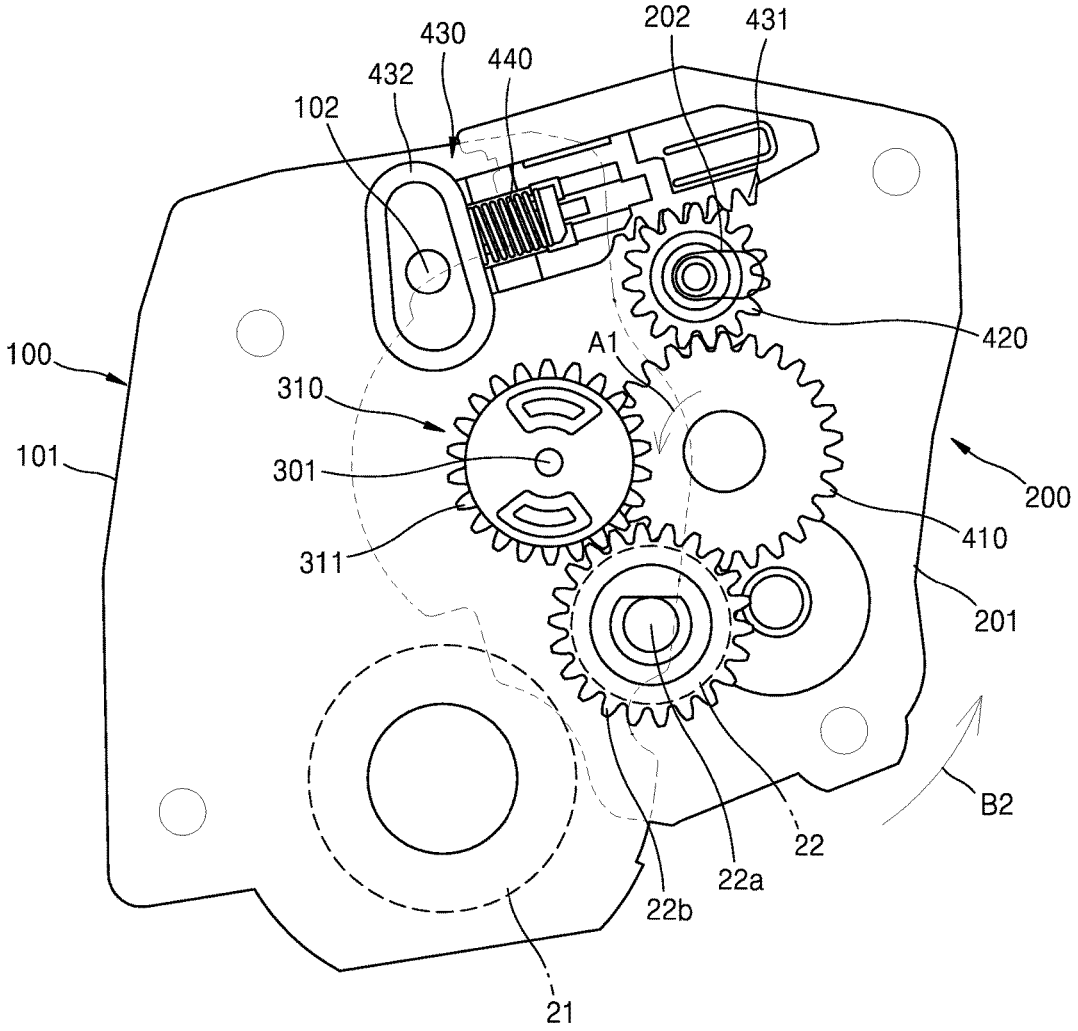
FIG. 5 is a schematic side view illustrating the developing cartridge of the example shown in FIG. 4 when a developing unit is at a release position.

FIG. 4 is a schematic side view illustrating a developing cartridge 2 according to an example. FIG. 5 is a schematic side view illustrating the developing cartridge 2 of the example shown in FIG. 4 when a developing unit 200 is at a release position. Referring to FIGS. 4 and 5, the developing cartridge 2 includes a driving gear 410. For example, the driving gear 410 may be connected to a coupler 310 and may be rotated. In the current example, the coupler 310 includes a gear portion 311, and the gear portion 311 engages with a developing roller gear **22*b* coupled to a rotation shaft 22*a* of a developing roller 22. The driving gear 410 engages with the developing roller gear 22*b***.

The developing unit 200 includes a movable member 430. The movable member 430 rotates the developing unit 200 on a hinge shaft 301 to switch the developing unit 200 between a developing position and the release position. To this end, the movable member 430 is installed on the developing unit 200, for example, on a second frame 201 of the developing unit 200 such that the movable member 430 may be moved to a first position and a second position respectively corresponding to the release position and the developing position. The movable member 430 includes a gear portion 431. The movable member 430 of the current example is slidable to the first and second positions, and the gear portion 431 is a rack gear. The movable member 430 is moved to the first or second position according to the rotation direction of the driving gear 410. For example, when printing is not performed, the driving gear 410 is rotated in a first direction A1, and when printing is performed, the driving gear 410 is rotated in a second direction A2. Hereinafter, when the rotation direction of the driving gear 410 is described, the first direction A1 refers to a non-printing rotation direction, and the second direction A2 refers to a printing rotation direction.

The movable member 430 includes a second connection portion 432 connected to a first connection portion 102 provided on a photosensitive unit 100, for example, on a first frame 101. For example, the first connection portion 102 may have a protrusion shape, and the second connection portion 432 may have a ring shape into which the first connection portion 102 is insertable. The shapes of the first and second connection portions 102 and 432 are not limited to the shapes shown in FIG. 4.

A switching member is provided between the movable member 430 and the driving gear 410. The switching member is connected to the driving gear 410 and is rotated. As the driving gear 410 is rotated in the first or second direction A1 or A2, the switching member is switched between: a third position at which the switching member is connected to the gear portion 431 and moves the movable member 430 from the second position to the first position; and a fourth position at which the switching member is spaced apart from the gear portion 431 and allows the movable member 430 to move from the first position to the second position.

In the current example, a swing gear 420 is used as the switching member. The swing gear 420 engages with the driving gear 410 and swings between the third position (FIG. 5) and the fourth position (FIG. 4) according to rotation of the driving gear 410. If the driving gear 410 rotates in the first direction A1, the swing gear 420 moves to the third position and engages with the gear portion 431 as shown in FIG. 5. If the driving gear 410 rotates in the second direction A2, the swing gear 420 moves to the fourth position and departs from the gear portion 431 as shown in FIG. 4. A guide portion 202 may be provided on the developing unit 200, for example, on the second frame 201 such that the swing gear 420 may swing between the third and fourth positions. The guide portion 202 may have a long hole shape.

With reference to FIGS. 4 and 5, operations of forming/releasing a developing nip N will now be described.

Referring to FIG. 4, the developing unit 200 is at the developing position, the movable member 430 is at the second position, and the swing gear 420 is at the fourth position. When a motor (not shown) of a main body 1 rotates in a forward direction for printing, rotation power of the motor is transmitted to the driving gear 410 through the coupler 310, and thus the driving gear 410 is rotated in the second direction A2. Then, the swing gear 420 is placed at the fourth position and maintained separate from the gear portion 431 as shown in FIG. 4. Therefore, the movable member 430 is maintained at the second position, and printing may be performed in a state in which a developing nip N is formed.

If the motor (not shown) of the main body 1 rotates in a reverse direction when printing is not performed, rotation power of the motor is transmitted to the driving gear 410 through the coupler 310, and thus the driving gear 410 is rotated in the first direction A1. Then, the swing gear 420 is swung to the third position and engaged with the gear portion 431 as shown in FIG. 5. If the driving gear 410 is further rotated in the first direction A1, the swing gear 420 is rotated in a state in which the swing gear 420 is engaged with the gear portion 431. The movable member 430 is slid from the fourth position to the third position, and the second connection portion 432 pulls the first connection portion 102. Since the position of the photosensitive unit 100 is fixed, the developing unit 200 is rotated on the hinge shaft 301 in an arrow direction B2. As shown in FIGS. 3 and 5, as the movable member 430 reaches the third position, the developing unit 200 reaches the release position, and the developing roller 22 is spaced apart from the photosensitive drum 21, releasing the developing nip N.

When the motor stops, the developing unit 200 may be maintained at the release position. The developing unit 200 is biased to the developing position by elastic force applied from the elastic member 330. However, the motor, the coupler 310, the driving gear 410, the swing gear 420, and the gear portion 431 are engaged with each other, the developing unit 200 may be maintained at the release position.

In the state shown in FIG. 5, if the motor rotates in the forward direction for printing, rotation power of the motor is transmitted to the driving gear 410 through the coupler 310, and thus the driving gear 410 is rotated in the second direction A2. Then, as shown in FIG. 4, the swing gear 420 is swung to the fourth position, and the developing unit 200 is rotated in an arrow direction B1 by elastic force applied from the elastic member 330. Since the first and second connection portions 102 and 432 are connected to each other, the movable member 430 is slid to the second position. At the second position, the swing gear 420 is apart from the gear portion 431. Therefore, the movable member 430 is maintained at the second position, and printing may be performed in a state in which the developing nip N is formed.

According to the example of the developing cartridge 2, the developing nip N may be formed/released by rotating the driving gear 410, and thus it is not necessary to install a mechanical structure for forming/releasing a developing nip N in the main body 1, thereby decreasing the number of components of the main body 1 and enabling cost reduction and size reduction. In addition, the developing nip N may be self-released by the developing cartridge 2, and thus a separate releasing member for maintaining the state in which the developing nip N is released may not be installed in the developing cartridge 2. Therefore, when the developing cartridge 2 is first installed in the main body 1, it may not be necessary to inconveniently remove a releasing member.

The developing cartridge 2 may further include a locking member to lock the movable member 430 at the first position and thus to stably maintain the developing unit 200 at the release position.

Figure 6:
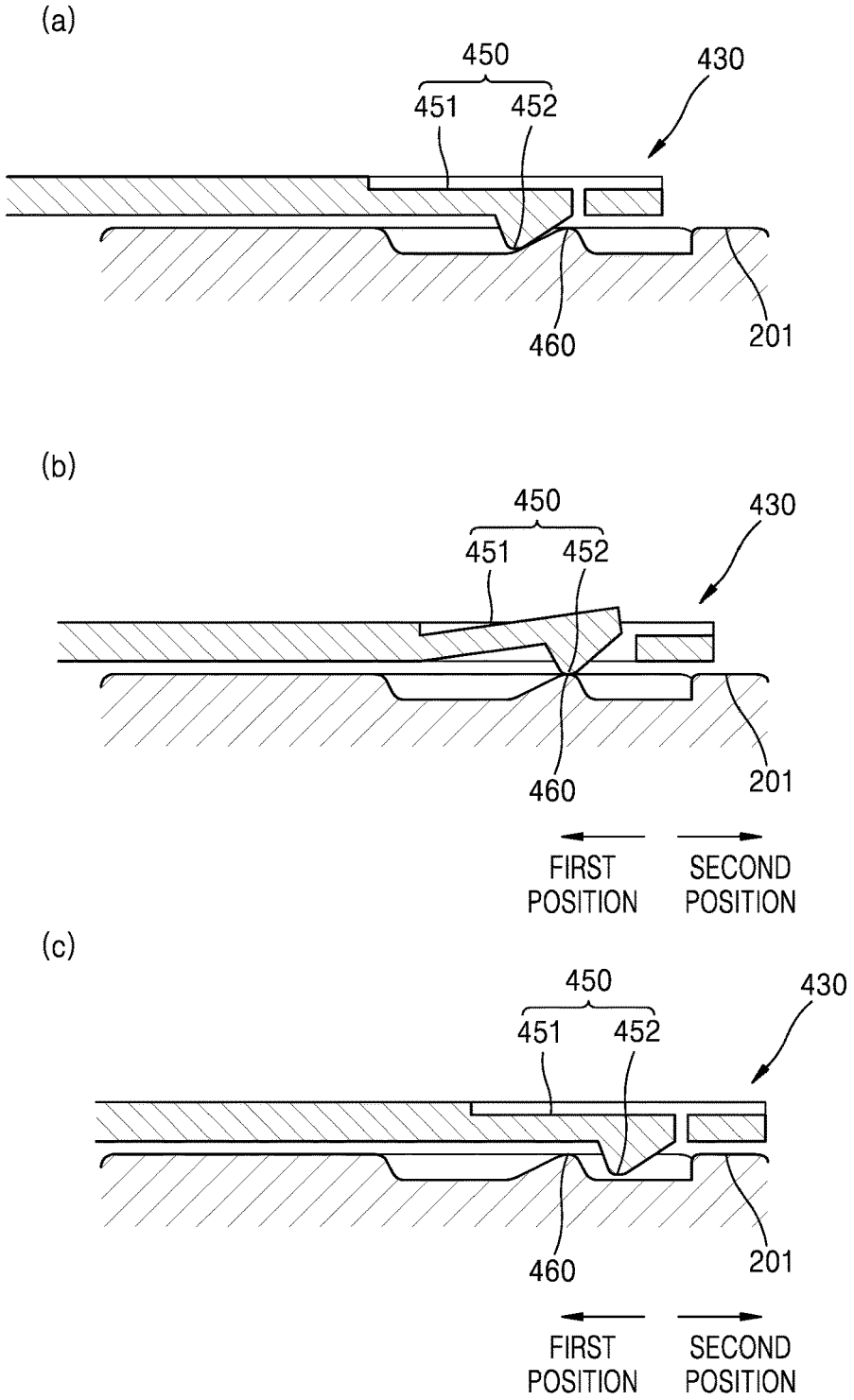
FIG. 6 shows schematic cross-sectional views illustrating a locking member according to an example.

FIG. 6 shows schematic cross-sectional views illustrating the locking member according to an example. Referring to FIG. 6, the locking member includes first and second coupling portions 450 and 460 configured to be elastically coupled to each other when the movable member 430 is at the first position. For example, the first coupling portion 450 may include an elastic arm 451 provided on the movable member 430 and a hook 452 protruding from the elastic arm 451. The second coupling portion 460 may be a jaw 460 provided on the developing unit 200, for example, on the second frame 201. (c), (b), and (a) of FIG. 6 sequentially correspond to a movement of the movable member 430 from the second position to the first position. (c) of FIG. 6 illustrates a state in which the movable member 430 is at the second position. In this state, if the movable member 430 is moved toward the first position, as shown in (b) of FIG. 6, the hook 452 is brought into contact with the jaw 460, and the elastic arm 451 is elastically bent such that the hook 452 may go over the jaw 460 to the first position. If the movable member 430 reaches the first position, the hook 452 is hooked on the jaw 460 as shown in (a) of FIG. 6. If the motor stops in this state, since the motor, the coupler 310, the driving gear 410, the swing gear 420, and the gear portion 431 are engaged with each other, and the hook 452 is hooked on the jaw 460, the movable member 430 is maintained at the first position, and the developing unit 200 may be stably maintained at the developing position.

(a), (b), and (c) of FIG. 6 sequentially correspond to a movement of the movable member 430 from the first position to the second position. Owing to pulling force applied by the swing gear 420 engaged with the gear portion 431 to move the movable member 430 from the first position to the second position, and elastic force applied by the elastic member 330 to rotate the developing unit 200 in the direction B1, the hook 452 may go over the jaw 460, and thus the movable member 430 may be moved from the first position to the second position.

In the configuration shown in FIG. 6, the first coupling portion 450 includes the elastic arm 451 and the hook 452. However, the second coupling portion 460 may include the elastic arm 451 and the hook 452.

Referring again to FIGS. 4 and 5, the developing cartridge 2 may further include a return spring 440 to more stably return the movable member 430 to the second position. The return spring 440 applies elastic force to the movable member 430 in a direction maintaining the movable member 430 at the second position. For example, the return spring 440 may be a compression coil spring having an end portion supported by the developing unit 200, for example, by the second frame 201, and the other end portion supported by the movable member 430. However, the return spring 440 is not limited thereto. For example, a spring selected from various springs such as a tension coil spring, a torsion spring, and a leaf spring may be used as the return spring 440.

Figure 7:
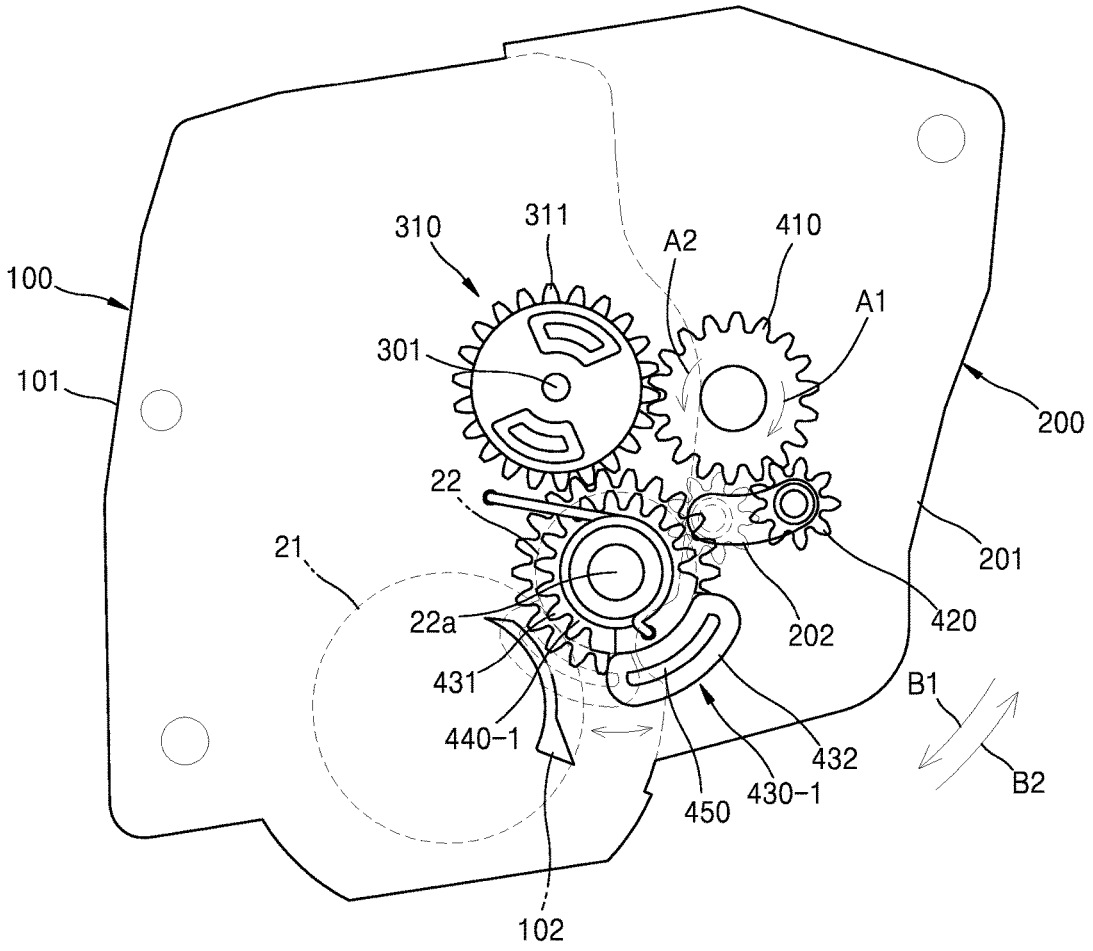
FIG. 7 is a schematic side view illustrating a developing cartridge according to an example.

FIG. 7 is a schematic side view illustrating a developing cartridge 2 according to an example. The developing cartridge 2 of the current example is different from the developing cartridge 2 shown in FIG. 4 in that the developing cartridge 2 includes a movable member 430-1 rotatable between first and second positions.

Referring to FIG. 7, the movable member 430-1 is provided to a developing unit 200 in such a manner that the movable member 430-1 is rotatable between the first position (indicated by dashed lines in FIG. 7) and the second position (indicated by solid lines in FIG. 7). For example, the movable member 430-1 is rotatably provided on a rotation shaft 22*a* of a developing roller 22. A torsion spring having an end portion connected to the developing unit 200 and the other end portion connected to the movable member 430-1 is used as a return spring 440-1 applying elastic force to the movable member 430-1 in a direction for maintaining the movable member 430-1 at the second position. A driving gear 410 engages with a gear portion 311 of a coupler 310. The driving gear 410 rotates in a first direction A1 when printing is not performed and in a second direction A2 when printing is performed.

When the driving gear 410 rotates in the second direction A2, a swing gear 420 moves to a fourth position away from a gear portion 431 of the movable member 430-1 as indicated by solid lines in FIG. 7. The movable member 430-1 may be maintained at the second position by elastic force of the return spring 440-1.

When the driving gear 410 rotates in the first direction A1, the swing gear 420 swings to a third position and engages with the gear portion 431 of the movable member 430-1 as indicated by dashed lines in FIG. 7. The gear portion 431 has a pinion shape. If the driving gear 410 further rotates in the first direction A1, the movable member 430-1 is rotated to the first position as indicated by the dashed lines in FIG. 7. At this time, a second connection portion 432 pushes a first connection portion 102. As the developing unit 200 is rotated in an arrow direction B2 with respect to a photosensitive unit 100, the developing roller 22 is spaced apart from a photosensitive drum 21.

If the driving gear 410 rotates again in the second direction A2, the swing gear 420 moves back to the fourth position away from the gear portion 431. The developing unit 200 is rotated in an arrow direction B1 by elastic force applied by an elastic member 330, and the movable member 430-1 is rotated to the second position. Owing to elastic force applied by the return spring 440-1, the movable member 430-1 may be stably returned to and maintained at the second position.

The example of the locking member shown in FIG. 6 may be applied to the example shown in FIG. 7.

Figure 8:
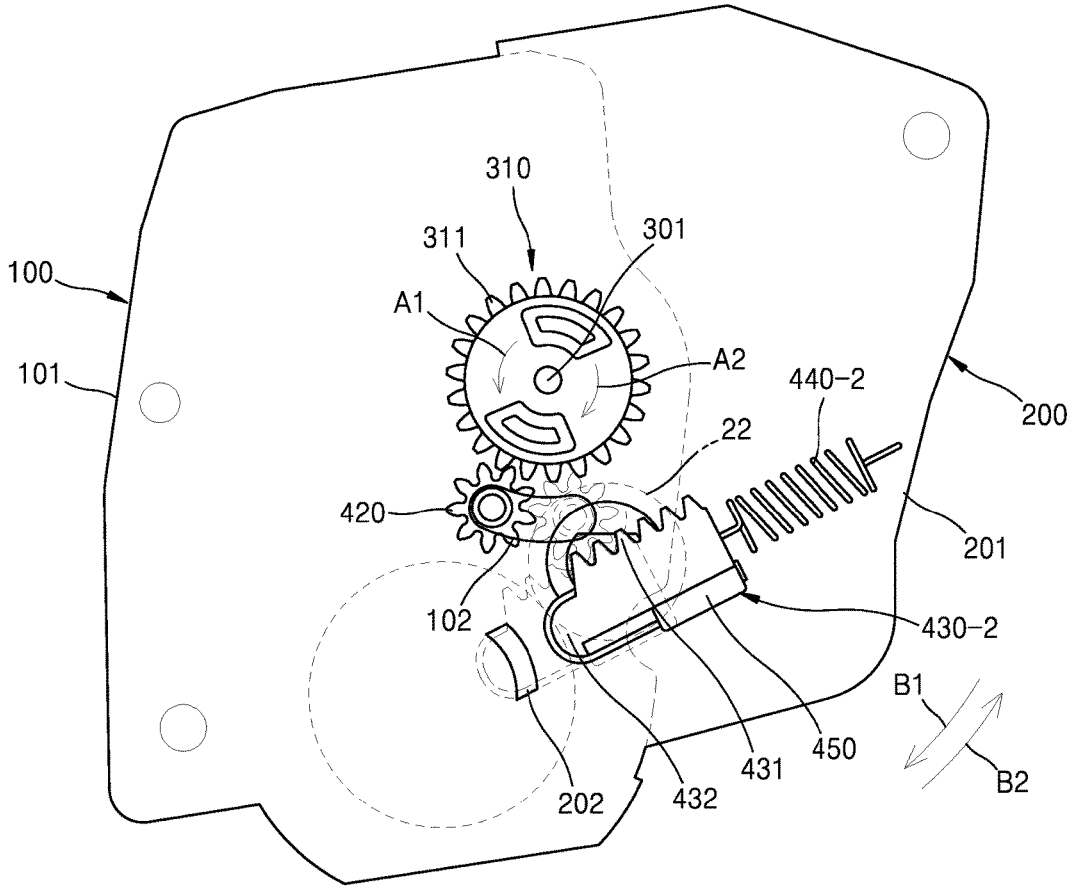
FIG. 8 is a schematic side view illustrating a developing cartridge according to an example.

FIG. 8 is a schematic side view illustrating a developing cartridge 2 according to an example. The developing cartridge 2 of the current example is different from the developing cartridge 2 shown in FIG. 4 in that a movable member 430-2 is placed at a side of a developing roller 22 with respect to a hinge shaft 301.

Referring to FIG. 8, the movable member 430-2 is provided to a developing unit 200 in such a manner that the movable member 430-2 is slidable between a first position (indicated by dashed lines in FIG. 8) and a second position (indicated by solid lines in FIG. 8). For example, the movable member 430-2 is provided to the developing unit 200, specifically, to a second frame 201 of the developing unit 200 in such a manner that the movable member 430-2 is slidable between the first and second positions. A tensile spring having an end portion connected to the developing unit 200 and the other end portion connected to the movable member 430-2 is used as a return spring 440-2 applying elastic force to the movable member 430-2 in a direction for maintaining the movable member 430-2 at the second position. A gear portion 311 of a coupler 310 functions as a driving gear. The coupler 310 rotates in a first direction A1 when printing is not performed and in a second direction A2 when printing is performed.

When the coupler 310 rotates in the second direction A2, a swing gear 420 moves to a fourth position away from a gear portion 431 of the movable member 430-2 as indicated by solid lines in FIG. 8. The movable member 430-2 may be maintained at the second position by elastic force of the return spring 440-1.

When the coupler 310 rotates in the first direction A1, the swing gear 420 swings to a third position and engages with the gear portion 431 of the movable member 430-2 as indicated by dashed lines in FIG. 8. The gear portion 431 has a rack gear shape. If the coupler 310 further rotates in the first direction A1, the movable member 430-2 is slid to the first position as indicated by the dashed lines in FIG. 8. At this time, a second connection portion 432 pushes a first connection portion 102. As the developing unit 200 is rotated in an arrow direction B2 with respect to a photosensitive unit 100, the developing roller 22 is spaced apart from a photosensitive drum 21.

If the coupler 310 rotates again in the second direction A2, the swing gear 420 moves back to the fourth position away from the gear portion 431. The developing unit 200 is rotated in an arrow direction B1 by elastic force applied by an elastic member 330, and the movable member 430-2 is slid to the second position. Owing to elastic force applied by the return spring 440-2, the movable member 430-2 may be stably returned to and maintained at the second position.

The example of the locking member shown in FIG. 6 may be applied to the example shown in FIG. 8.

Figure 9:
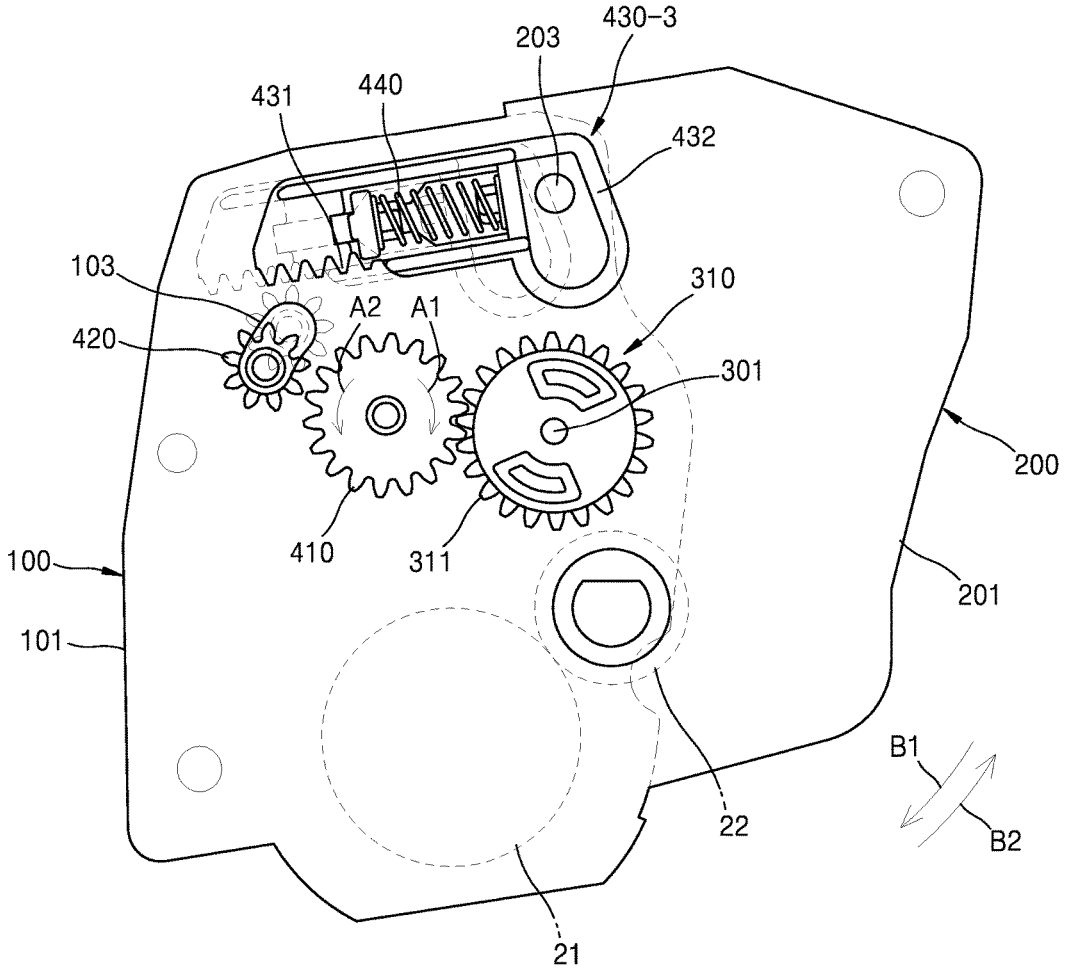
FIG. 9 is a schematic side view illustrating a developing cartridge according to an example.

FIG. 9 is a schematic side view illustrating a developing cartridge 2 according to an example. The developing cartridge 2 of the current example is different from the developing cartridge 2 shown in FIG. 4 in that a driving gear 410, a movable member 430-3, and a swing gear 420 are provided to a photosensitive unit 100.

Referring to FIG. 9, the movable member 430-3 is provided to the photosensitive unit 100 in such a manner that the movable member 430-3 is slidable between a first position (indicated by dashed lines in FIG. 9) and a second position (indicated by solid lines in FIG. 8). For example, the movable member 43032 is provided to the photosensitive unit 100, specifically, to a first frame 101 of the photosensitive unit 100 in such a manner that the movable member 430-3 is slidable between the first and second positions. A compression coil spring having an end portion supported on the photosensitive unit 100 and the other end portion supported on the movable member 430-3 is used as a return spring 440 applying elastic force to the movable member 430-3 in a direction for maintaining the movable member 430-3 at the second position. A driving gear 410 is provided to the photosensitive unit 100 and engaged with a gear portion 311 of a coupler 310. The driving gear 410 rotates in a first direction A1 when printing is not performed and in a second direction A2 when printing is performed.

A swing gear 420 is configured to swing between third and fourth positions while being guided by a guide portion 103 provided on the photosensitive unit 100. When the driving gear 410 rotates in the second direction A2, the swing gear 420 moves to the fourth position away from a gear portion 431 of the movable member 430-3 as indicated by solid lines in FIG. 9. The movable member 430-3 may be maintained at the second position by elastic force of the return spring 440.

When the driving gear 410 rotates in the first direction A1, the swing gear 420 swings to the third position and engages with the gear portion 431 of the movable member 430-3 as indicated by dashed lines in FIG. 9. The gear portion 431 has a rack gear shape. If the driving gear 410 further rotates in the first direction A1, the movable member 430-3 is slid to the first position as indicated by the dashed lines in FIG. 9. At this time, a second connection portion 432 pushes a first connection portion 203 having a protrusion shape and provided on a developing unit 200. As the developing unit 200 is rotated in an arrow direction B2 with respect to the photosensitive unit 100, a developing roller 22 is spaced apart from a photosensitive drum 21.

If the driving gear 410 rotates again in the second direction A2, the swing gear 420 moves back to the fourth position away from the gear portion 431. The developing unit 200 is rotated in an arrow direction B1 by elastic force applied by an elastic member 330, and the movable member 430-3 is slid to the second position. Owing to elastic force applied by the return spring 440, the movable member 430-3 may be stably returned to and maintained at the second position.

The example of the locking member shown in FIG. 6 may be applied to the example shown in FIG. 9.

In the above-described examples, the swing gears 420 are used as switching members. However, different switching member may be used.

Figure 10:
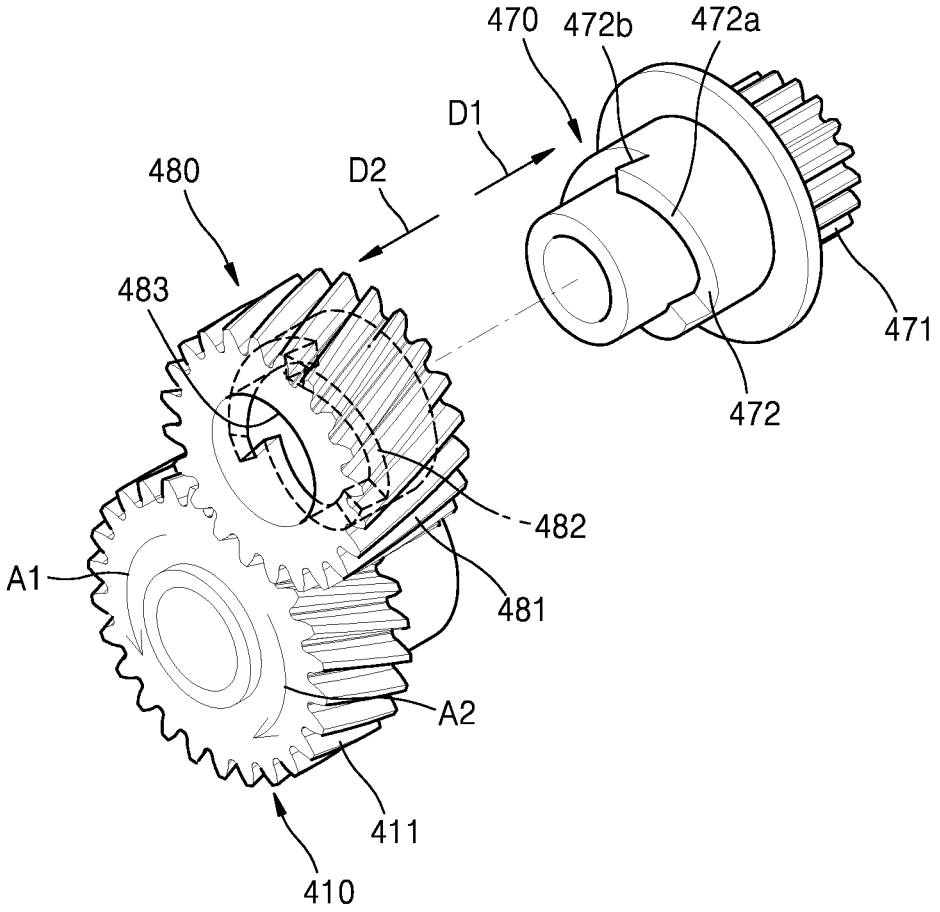
FIG. 10 is an exploded perspective view illustrating a switching member according to an example.

FIG. 10 is an exploded perspective view illustrating a switching member according to an example. The switching member of the current example may replace any one of the swing gears 420 described with reference to FIGS. 4, 7, 8, and 9. The following description will be given for the case in which the switching member of the current example replaces the swing gear 420 illustrated in FIG. 4.

Referring to FIG. 10, a driving gear 410 includes a first helical gear portion 411. The switching member includes a first rotary member 470 and a second rotary member 480. The first rotary member 470 includes: a pinion gear portion 471 engaging with the gear portion 431 of the movable member 430; and a first latch portion 472. The second rotary member 480 includes: a second helical gear portion 481 engaging with the first helical gear portion 411; and a second latch portion 482. The first rotary member 470 and the second rotary member 480 are coaxially provided. The first and second latch portions 472 and 482 are configured to transmit rotary power in a single direction. That is, the first and second latch portions 472 and 482 may engage with each other and transmit rotary power when being rotated in one direction, but may depart from each other when being rotated in the other direction. For example, as shown in FIG. 10, the first latch portion 472 may include: slopes 472*a* extending in a circumferential direction and inclined with respect to an axial direction; and facing surfaces 472*b* extending from the slopes 472*a* in a radial direction. The second latch portion 482 may have a shape complementary to the shape of the first latch portion 472. A penetration hole 483 is defined in a center portion of the second rotary member 480, and the second latch portion 482 may be formed on an inner wall of the penetration hole 483. The first latch portion 472 is inserted into the penetration hole 483. Owning to this configuration, the second rotary member 480 may move in the axial direction while rotating coaxially with the first rotary member 470.

The helical directions of the first and second helical gear portions 411 and 481 are determined such that when the driving gear 410 rotates in a first direction A1, thrust may be generated in a direction D1 for moving the first and second latch portions 472 and 482 close to each other. Therefore, when the driving gear 410 rotates in the first direction A1, the second rotary member 480 moves to a third position in the direction D1, and thus the first and second latch portions 472 and 482 engage with each other. Rotary power generated by the driving gear 410 in the first direction A1 is transmitted to the first rotary member 470 through the second rotary member 480. Therefore, since the pinion gear portion 471 is engaged with the gear portion 431 of the movable member 430, the movable member 430 is moved to the first position as the first rotary member 470 rotates.

When the driving gear 410 rotates in a second direction A2, thrust is applied to the second rotary member 480 in a direction D2 opposite the direction D1. Therefore, the second rotary member 480 is moved to a fourth position in the direction D2, and the first and second latch portions 472 and 482 are spaced apart from each other. In addition, when the driving gear 410 rotates in the second direction A2, since the second rotary member 480 is rotated in a direction for pushing the first and second latch portions 472 and 482 away from each other, the second rotary member 480 may be easily moved in the direction D2. Therefore, rotary power generated by the driving gear 410 in the second direction A2 is not transmitted to the first rotary member 470 and the movable member 430. When the driving gear 410 rotates in the second direction A2, since the first rotary member 470 is in an idle state in which the first rotary member 470 is not connected to the driving gear 410, locking for maintaining the movable member 430 at the first position by engagement of gears is released. Therefore, as the developing unit 200 is rotated to the developing position by elastic force of the elastic member 330, the movable member 430 is moved from the first position to the second position. As the movable member 430 is moved from the first position to the second position, the first rotary member 470 is engaged with the gear portion 431 and smoothly rotated. The return spring 440 is helpful for stable movement of the movable member 430 to the first position.

Figure 11:
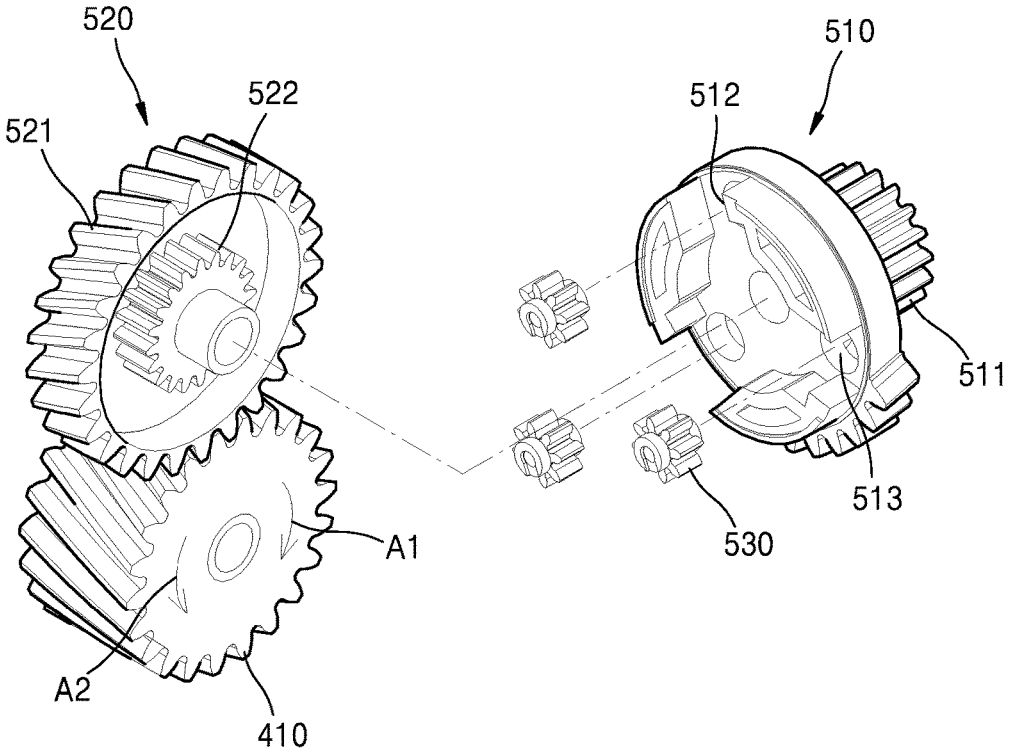
FIG. 11 is an exploded perspective view illustrating a switching member according to an example.
Figure 12:
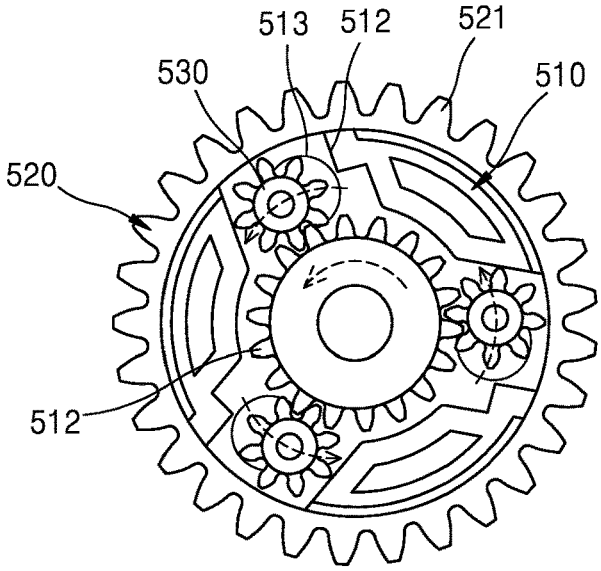
FIG. 12 is a view illustrating the switching member of the example shown in FIG. 11 when a driving gear rotates in a first direction.
Figure 13:
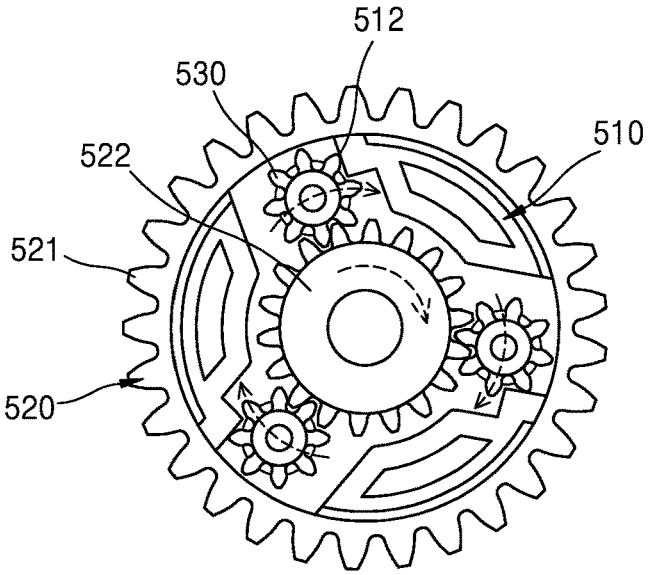
FIG. 13 is a view illustrating the switching member of the example shown in FIG. 11 when the driving gear rotates in a second direction.

FIG. 11 is an exploded perspective view illustrating a switching member according to an example. FIG. 12 illustrates the switching member of the example shown in FIG. 11 when a driving gear rotates in a first direction. FIG. 13 illustrates the switching member of the example shown in FIG. 11 when the driving gear rotates in a second direction. The switching member of the current example may replace any one of the swing gears 420 described with reference to FIGS. 4, 7, 8, and 9. The following description will be given for the case in which the switching member of the current example replaces the swing gear 420 illustrated in FIG. 4.

Referring to FIG. 11, the switching member includes a first rotary member 510, a second rotary member 520, and latch gears 530. The first rotary member 510 includes a pinion gear portion 511, latch portions 512, and guide portions 513. The pinion gear portion 511 engages with the gear portion 431 of the movable member 430. The latch gears 530 are installed in the guide portions 513 in a state in which the latch gears 530 are allowed to swing and rotate. The second rotary member 520 engages with and rotates together with the driving gear 410. The second rotary member 520 includes an outer gear portion 521 and an inner gear portion 522. The outer gear portion 521 engages with the driving gear 410. The inner gear portion 522 engages with the latch gears 530. According to the rotation direction of the second rotary member 520, the latch gears 530 move (swing) to a third position (FIG. 12) at which the latch gears 530 engage with the latch portions 512 or a fourth position (FIG. 13) at which the latch gears 530 are spaced apart from the latch portions 512.

If the driving gear 410 rotates in a first direction A1, the latch gears 530 swing along the guide portions 513 in the rotation direction of the second rotary member 520 and engage with the latch portions 512 as shown in FIG. 12. In this state, the latch gears 530 do not rotate, and the first rotary member 510 rotates together with the second rotary member 520. Rotary power generated by the driving gear 410 in the first direction A1 is transmitted to the first rotary member 510 through the second rotary member 520. Since the pinion gear portion 511 is engaged with the gear portion 431 of the movable member 430, the movable member 430 is moved to the first position as the first rotary member 510 rotates.

If the driving gear 410 rotates in a second direction A2, the latch gears 530 swing along the guide portions 513 in the rotation direction of the second rotary member 520 and depart from the latch portions 512 as shown in FIG. 13. The latch gears 530 rotate inside the guide portions 513. Therefore, rotary power generated by the driving gear 410 in the second direction A2 is not transmitted to the first rotary member 510 and the movable member 430. When the driving gear 410 rotates in the second direction A2, since the first rotary member 510 is in an idle state in which the first rotary member 510 is not connected to the driving gear 410, locking for maintaining the movable member 430 at the first position by engagement of gears is released. Therefore, as the developing unit 200 is rotated to the developing position by elastic force of the elastic member 330, the movable member 430 is moved from the first position to the second position. As the movable member 430 is moved from the first position to the second position, the first rotary member 510 is engaged with the gear portion 431 and smoothly rotated. The return spring 440 is helpful for stable movement of the movable member 430 to the first position.

Figure 14:
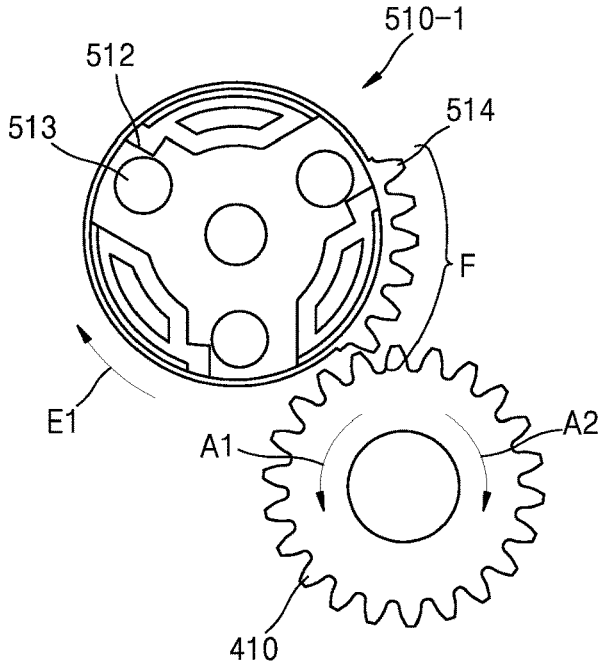
FIGS. 14 and 15 are side views illustrating a modified example of the switching member of the example shown in FIGS. 11 to 13.
Figure 15:
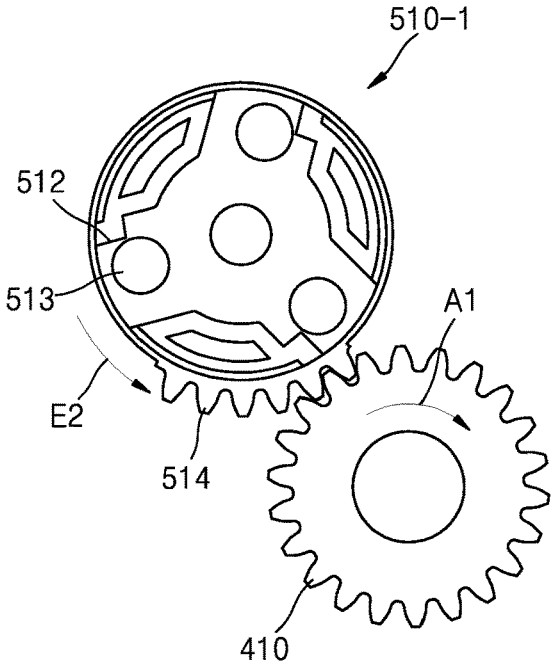

FIGS. 14 and 15 are side views a modified example of the switching member of the example shown in FIGS. 11 to 13. In FIGS. 14 and 15, a second rotary member 520 is omitted. The switching member of the current example may replace any one of the swing gears 420 described with reference to FIGS. 4, 7, 8, and 9. The following description will be given for the case in which the switching member of the current example replaces the swing gear 420 illustrated in FIG. 4. Referring to FIG. 14, a first rotary member 510-1 is different from the first rotary member 510 shown in FIG. 11 in that the first rotary member 510-1 includes a partial gear portion 514. The partial gear portion 514 selectively engages with the driving gear 410.

When the movable member 430 is at the second position, the partial gear portion 514 does not engage with the driving gear 410. In this state, if the driving gear 410 rotates in a first direction A1, the latch gears 530 engage with the latch portions 512 as shown in FIG. 12, and the first rotary member 510 rotates in a direction E1. Then, the partial gear portion 514 engages with the driving gear 410, and the first rotary member 510 is rotated in the direction E1 by the driving gear 410. The movable member 430 is moved from the second position to the first position. Since the second rotary member 520 is engaged with the driving gear 410, the second rotary member 520 is also rotated in the direction E1. When the movable member 430 reaches the first position, the driving gear 410 stops. At this time, as shown in FIG. 15, the partial gear portion 514 is maintained in a state in which the partial gear portion 514 is engaged with the driving gear 410.

If the driving gear 410 is rotated in a second direction A2, since the partial gear portion 514 is engaged with the driving gear 410, the first rotary member 510 is rotated in a direction E2, and the movable member 430 is moved from the first position to the second position. Since the second rotary member 520 is engaged with the driving gear 410, the second rotary member 520 is also rotated in the direction E2. When the movable member 430 reaches the second position, the partial gear portion 514 disengages from the driving gear 410.

The range in which the partial gear portion 514 is formed may be properly determined by considering the sliding stroke of the movable member 430.

According to the above-described configuration, the movable member 430 may be stably returned to the second position.

While the present disclosure has been described with reference to the accompanying drawings according to examples, these examples are for illustrative purposes, and it will be understood by those of ordinary skill in the art that various changes and other equivalent examples may be made therefrom. Therefore, the scope and spirit of the present disclosure should be defined by the following claims.

The invention claimed is:

1. A developing cartridge comprising:
- a photosensitive unit including a photosensitive drum;
- a developing unit including a developing roller, the developing unit coupled to the photosensitive unit to be movable to:
  - a release position at which the developing roller is spaced apart from the photosensitive drum, and
  - a developing position at which the developing roller contacts the photosensitive drum to form a developing nip;
- an elastic member to provide an elastic force in a direction to maintain the developing unit at the developing position;
- a movable member including a gear portion, the movable member movable to:
  - a first position to cause the developing unit to move to the release position, and
  - a second position to cause the developing unit to move to the developing position;
  - a driving gear rotatable in a first direction and a second direction; and
- a switching member connected to the driving gear, the switching member to switch between:
  - a third position at which the switching member engages the gear portion to transmit power from the driving gear to the movable member from the second position to the first position, as the driving gear rotates in the first direction, and
  - a fourth position at which the switching member disengages the gear portion to allow the movable member to move from the first position to the second position, as the driving gear rotates in the second direction.

2. The developing cartridge of claim 1, further comprising a return spring to apply a spring elastic force to the movable member, in a direction to move the movable member to the second position.

3. The developing cartridge of claim 2, further comprising a locking member to lock the movable member at the first position.

4. The developing cartridge of claim 3, wherein
the locking member includes first and second coupling portions respectively provided on
the movable member and
one of the developing unit and/or the photosensitive unit on which the movable member is provided, and
the first and second coupling portions are elastically coupled to each other when the movable member is at the first position.

5. The developing cartridge of claim 1, wherein the switching member includes a swing gear
to engage the driving gear to be connected to the driving gear, to swing to the third position or the fourth position as the driving gear rotates in the first direction or the second direction, and
to engage with the gear portion at the third position to be connected to the gear portion.

6. The developing cartridge of claim 5, wherein
the movable member is provided on the developing unit and is slidable between the first position and the second position, and
the gear portion includes a rack gear.

7. The developing cartridge of claim 6, further comprising:
a coupler to receive driving power; and
a developing roller gear to be rotated by the coupler and coupled to a rotation shaft of the developing roller,
wherein the driving gear engages with the developing roller gear to rotate together with the developing roller gear.

8. The developing cartridge of claim 5, wherein
the movable member is provided on the photosensitive unit and is slidable between the first position and the second position, and
the gear portion includes a rack gear.

9. The developing cartridge of claim 5, wherein the movable member is provided on the developing unit and movable between the first position and the second position.

10. The developing cartridge of claim 1, wherein
the driving gear includes a first helical gear portion, and
the switching member includes:
a first rotary member including
a first latch portion and
a pinion gear portion engaging with the gear portion; and
a second rotary member including
a second latch portion and
a second helical gear portion engaging with the first helical gear portion, the second rotary member being provided coaxially with the first rotary member,
wherein, as the driving gear rotates in the first direction and the second direction, the second rotary member reciprocates in an axial direction and switches between
the third position at which the second latch portion engages with the first latch portion, to be connected to the gear portion to move the movable member from the second position to the first position, as the driving gear rotates in the first direction, and
the fourth position at which the second latch portion is spaced apart from the first latch portion, to be disconnected from the gear portion to allow the movable member to move from the first position to the second position, as the driving gear rotates in the second direction.

11. The developing cartridge of claim 1, wherein the switching member includes:
a first rotary member including
a pinion gear portion engaging with the gear portion,
a latch portion, and
a long hole portion having an arc shape;
a second rotary member provided coaxially with the first rotary member and engaging with the driving gear to rotate with the driving gear, the second rotary member including an inner gear portion; and
a latch gear engaging with the inner gear portion and being provided in the long hole portion,
the latch gear to, according to a rotation direction of the driving gear, be moved:
to the third position at which the latch gear engages with the latch portion such that the first rotary member rotates together with the first rotary member, or
to the fourth position at which the latch gear is separate from the latch portion.

12. The developing cartridge of claim 11, wherein
the first rotary member includes a partial gear portion, and
the partial gear portion engages with the driving gear when the first rotary member moves the movable member from the second position to the first position and is separate from the driving gear when the movable member is completely moved from the second position to the first position.

13. An image forming apparatus comprising:
a main body; and
a developing cartridge including:
a photosensitive unit including a photosensitive drum;
a developing unit including a developing roller, the developing unit coupled to the photosensitive unit to be movable to:
a release position at which the developing roller is spaced apart from the photosensitive drum, and
a developing position at which the developing roller contacts the photosensitive drum to form a developing nip;
an elastic member to provide an elastic force in a direction to maintain the developing unit at the developing position;
a movable member including a gear portion, the movable member movable to:
a first position to cause the developing unit to move to the release position, and
a second position to cause the developing unit to move to the developing position;
a driving gear rotatable in a first direction and a second direction; and
a switching member connected to the driving gear, the switching member to switch between:
a third position at which the switching member engages the gear portion to transmit power from the driving gear to move the movable member from the second position to the first position, as the driving gear rotates in the first direction, and
a fourth position at which the switching member disengages the gear portion to allow the movable member to move from the first position to the second position, as the driving gear rotates in the second direction.

14. The image forming apparatus of claim 13, wherein the switching member includes a swing gear to engage with the driving gear and swing to the third position or the fourth position according to a rotation direction of the driving gear, and to engage with the gear portion at the third position.

15. The image forming apparatus of claim 13, wherein the switching member includes:

a first rotary member; and a second rotary member provided coaxially with the first rotary member, wherein, as the driving gear is rotated in the first and second directions, the second rotary member switches between the third position at which the first rotary member engages with the second rotary member and the fourth position at which the first rotary member disengages the second rotary member.

* * * * *